United States Patent [19]

Hamrick

[11] 3,948,552

[45] Apr. 6, 1976

[54] BOTTLE GRIPPING APPARATUS

[76] Inventor: Gene H. Hamrick, 2407 Graham Road, Stow, Ohio 44224

[22] Filed: Jan. 8, 1975

[21] Appl. No.: 539,337

[52] U.S. Cl. ..... 294/115; 294/118

[51] Int. Cl.[2] ..... B66C 1/42

[58] Field of Search ..... 294/87 R, 87.22, 87.24, 294/106, 115, 118; 214/309

[56] References Cited

UNITED STATES PATENTS

| | | | |
|---|---|---|---|
| 1,191,702 | 7/1916 | Januszczak | 294/118 X |
| 2,277,828 | 3/1942 | Morgan | 294/87 R |
| 2,679,328 | 5/1954 | Ballato et al. | 214/309 |
| 3,021,169 | 2/1962 | Harry | 294/118 X |
| 3,125,369 | 3/1964 | Copping | 294/115 X |
| 3,125,370 | 3/1964 | McGill | 294/115 |
| 3,790,205 | 2/1974 | Wenz | 294/115 |

*Primary Examiner*—John J. Love
*Assistant Examiner*—Johnny D. Cherry
*Attorney, Agent, or Firm*—Hamilton, Renner & Kenner

[57] ABSTRACT

A bottle gripping apparatus having laterally spaced frame plates. The frame plates are pivotal and axially slidable on a mounting pin that may be secured to a supporting bar, or the like, on a conveyor means. A pair of first class lever arms are pivotal on a fulcrum extending between the frame plates in spaced relation below the mounting pin, and a first end of each lever arm presents a gripper jaw — the two gripper jaws being movable toward and away from each other by pivotal movement of the lever arms. A spring means is operatively connected between said second ends of the two lever arms biasingly to urge the two gripper jaws toward each other. A pair of links connect the second ends of the lever arms to a common control member that is mounted on the frame plates to be axially translatable with respect thereto.

6 Claims, 6 Drawing Figures

BOTTLE GRIPPING APPARATUS

BACKGROUND OF THE INVENTION

The present invention relates to apparatus for gripping, supporting and releasing articles such as bottles.

The prior art has developed a number of concepts for engaging, lifting, transporting and depositing bottles at desired locations for processing. By virtue of continued improvements the functional operation of prior art bottle gripping apparatus has been developed to a high degree of acceptability, and yet the construction of such apparatus requires undue duplication of parts that are not readily assembled or disassembled, particularly as required to facilitate maintenance.

As an example, one of the most successful prior art bottle gripping devices employs no less than three distinct spring elements that are secured within a riveted frame.

SUMMARY OF THE INVENTION

It is, therefore, a primary object of the present invention to provide a bottle gripping apparatus that is adapted for use on existing conveyor mechanisms being generally employed by bottle processors.

It is another object of the present invention to provide a bottle gripping apparatus, as above, that is self-centering.

It is a further object of the present invention to provide a bottle gripping apparatus, as above, that is axially and transversely movable: to "hunt" for and grasp misaligned bottles; to prevent binding of the bottles with the case from which they are being extracted or into which they are being deposited; and, to allow individual bottle gripping apparatus to accommodate an inverted bottle without breaking the bottle or preventing adjacent bottle gripping apparatus from operating in their normal fashion.

It is a still further object of the present invention to provide a bottle gripping apparatus, as above, in which a single spring means: biases the gripper jaws to their normally closed position; biases the apparatus to a predetermined disposition with respect to the supporting bar on which the apparatus is carried (i.e., accomplishes self-centering); and, provides the bias against which the gripping apparatus may be axially and pivotally moved.

It is an even further object of the present invention to provide a bottle gripping apparatus, as above, that is relatively uncomplicated and inexpensive to manufacture and maintain and yet is capable of providing a long and useful life under adverse working conditions.

These and other objects, as well as the advantages thereof over existing and prior art forms, will become apparent in view of the following detailed description of a preferred embodiment depicted by the attached drawings and are accomplished by means hereinafter described and claimed.

In general, a bottle gripping apparatus embodying the concept of the present invention has laterally spaced frame members that are carried on a supporting, or flight, bar so as to be both pivotal and slidable with respect thereto. A pair of first class lever arms are pivotally supported by the frame members, and a first end of each lever arm presents a gripper jaw that opposingly faces the gripper jaw presented from the other lever arm. A spring means is connected between the opposite, or second, ends of the two lever arms to bias the gripper jaws toward each other.

A control member is slidably mounted on the frame plates and is connected to the second end of each lever arm by corresponding links. The links serve as toggles not only to apply the biasing force of the spring means to the control member but also to transmit actuating forces imparted against the control member as required to overcome the biasing action of the spring means when opening the gripper jaws.

The yielding interengagement of shoulder means presented from the control member against the supporting bars on which the frame members are dependingly carried, as is also occasioned by the biasing pressure provided by the spring means, accomplishes self-centering of the apparatus. That is, the shoulders are selectively oriented so that the biasing action of the single spring means tends to urge the gripping apparatus toward a predetermined orientation — normally vertical, or, stated in terms of reference to the supporting bar, perpendicular with respect thereto.

One preferred embodiment of the subject invention is shown by way of example in the accompanying drawings and is described in detail without attempting to show all of the various forms and modifications in which the invention might be embodied; the invention being measured by the appended claims and not by the details of the specification.

DESCRIPTION OF A PREFERRED EMBODIMENT

Figure 1:
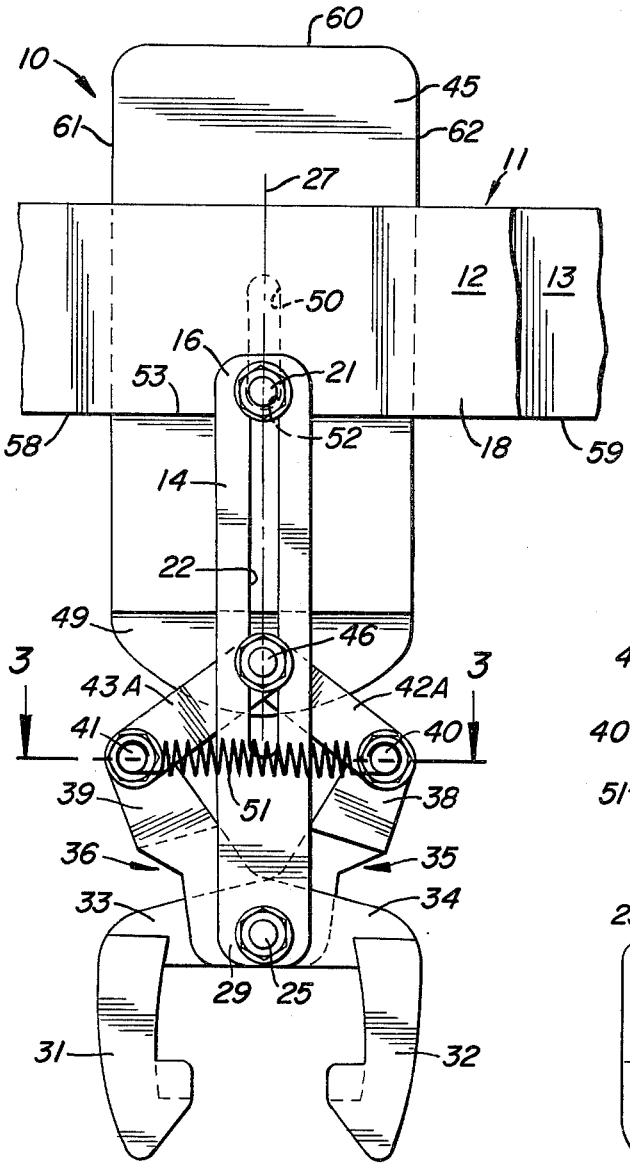
FIG. 1 is a side elevation of a bottle gripping apparatus embodying the concept of the present invention, said apparatus being mounted on a supporting element in a conveyor.
Figure 2:
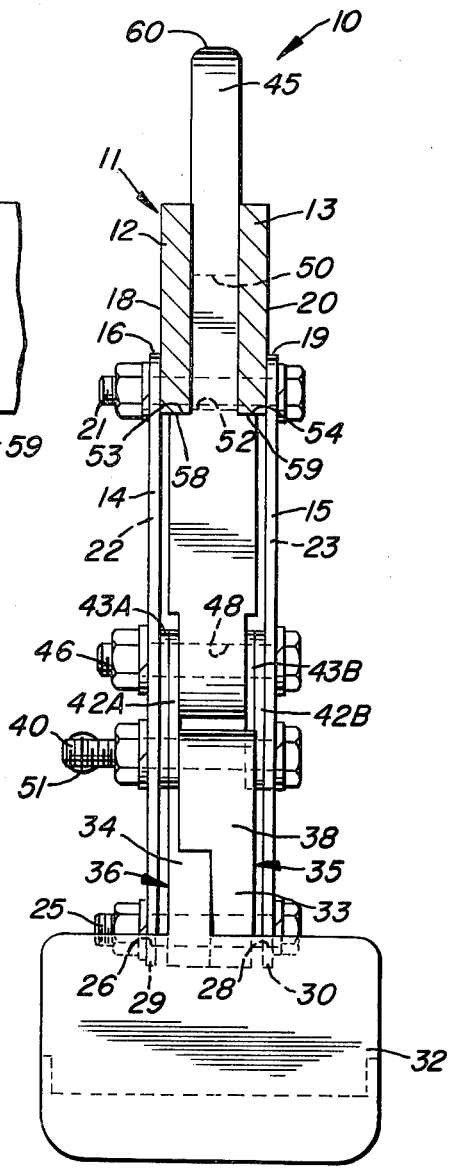
FIG. 2 is an elevation at 90° to the elevation of FIG. 1.
Figure 3:
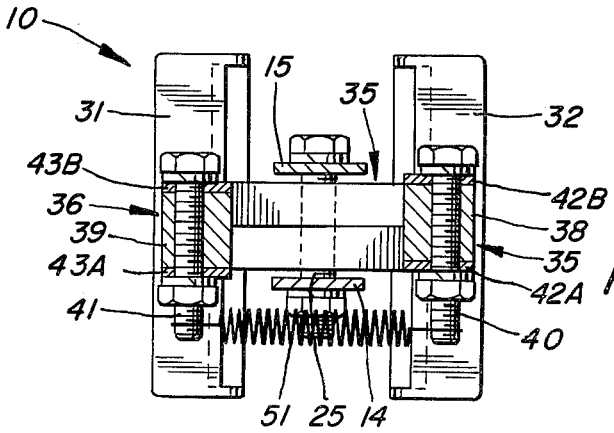
FIG. 3 is a transverse section taken substantially on line 3—3 of FIG. 1.

A bottle gripping apparatus embodying the concept of the present invention is designated generally by the numeral 10 on the attached drawings. The bottle gripping apparatus 10 is adapted to be mounted on a carrier 11 that preferably comprises a pair of laterally spaced supporting, or flight, bars 12 and 13 that are, in turn, supported on a conveyor, or the like (not shown), whereby the apparatus 10 can be moved from one place to another so that it can pick up and deposit a bottle at desired locations along its path of movement. It will be appreciated that by embodying a plurality of carriers 11, each of which supports one or more bottle gripping apparatus 10, a number of bottles can be simultaneously, and sequentially, moved, as desired.

Each bottle gripping apparatus 10 has a pair of vertically oriented, laterally spaced frame plates 14 and 15. The upper end portion 16 of frame plate 14 engages the outwardly directed side surface 18 of supporting bar 12, and the upper end portion 19 of frame plate 15 engages the outwardly directed surface 20 of supporting bar 13. The frame plates 14 and 15 are pivotally attached to the flight bars 12 and 13 by a mounting pin in the form of a bolt 21. The mounting pin 21 is received in vertically oriented, elongate guideways 22 and 23 in the respective frame plates 14 and 15 so that in addition to being pivotally mounted on the carrier 11, the frame plates 14 and 15 are also vertically slidable along their longitudinal axis 27.

A fulcrum pin in the form of a second bolt 25 passes through registered bores 26 and 28 in the laterally spaced, lower end portions 29 and 30 of the respective side frame plates 14 and 15 pivotally to support a pair of opposed gripper jaws 31 and 32. Each gripper jaw is presented from one end of a beam on a corresponding first class lever arm. The beam portions 33 and 34 of each lever arm 35 and 36 presenting the respective gripper jaws 31 and 32 converge to be disposed in lateral juxtaposition between the frame plates 14 and 15, and the bolt 25 passes through the beam portions 33 and 34 to comprise the fulcrum on which the gripper jaws 31 and 32 are pivotally mounted.

From that side of the bolt 25 opposite the corresponding gripper jaws 31 and 32 an offset throw portion 38 and 39 doglegs outwardly and upwardly from each beam portion 33 and 34. The outermost end of each throw portion 38 and 39 terminates laterally with respect to the vertical guideways 22 and 23 for a purpose that will hereinafter become more fully apparent and each is pivotally secured, as by pivot pins in the form of bolts 40 and 41, to one end of a pair of separate links 42 (A and B) and 43 (A and B).

The paired links 42 and 43 converge upwardly and inwardly from the respective pins 40 and 41 to a common pivotal pin connection with the control member 45. The common pivotal pin connection comprises a bolt 46 received through a bore 48 in the apex 49 of the control member 45 and slidable along the aforesaid guideways 22 and 23 in the frame plates 14 and 15.

The control member 45 is provided with a vertically oriented slot 50 within which the mounting bolt 21 is slidably received in order to permit the control member 45 to be vertically displaced with respect to the frame plates 14 and 15 and the carrier 11.

A tension spring 51 is secured between the pivot pins 40 and 41. Even one tension spring 51 serves to bias the gripper jaws 31 and 32 to their normally closed position (FIGS. 1 and 6) — thereby urging the control member 45 to its uppermost position and maintaining the apparatus 10 in its normal perpendicular relation with respect to the supporting bars 12 and 13.

The foregoing results are obtained because as the tension spring 51 normally contracts it applies a force which tends to move the pivot pins 40 and 41 toward each other. This movement swings the levers 35 and 36 about the common fulcrum formed by bolt 25 to move the gripper jaws 31 and 32 toward each other.

Movement of the pivot pins 40 and 41 toward each other also tends to drive the inclined links 42 and 43 against the common pivotal pin, or bolt 46, forcing it upwardly along the guideways 22 and 23 in the frame plates 14 and 15. This biasing force against the bolt 46 moves the control member 45 to its uppermost position, as may be defined by the interengagement of the lowermost lobe 52 of slot 50 against the mounting bolt 21.

Figure 5:
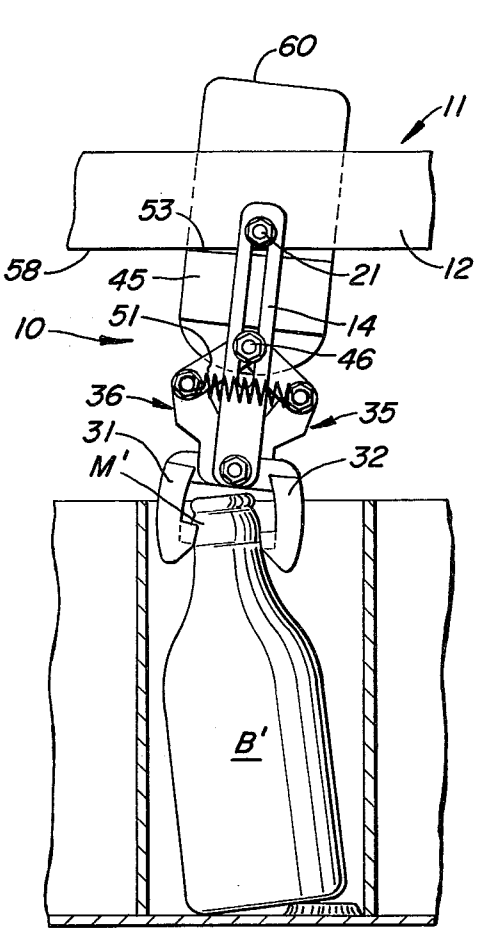
FIG. 5 is a schematic similar to FIG. 4 but depicting the gripping apparatus disposed in the position it would assume to grasp a tilted bottle; and, FIG. 6 is a schematic similar to FIGS. 4 and 5 but depicting the gripping apparatus disposed in the position it would assume to engage a normally oriented bottle.

In addition, or alternatively, the uppermost position of the control member 45 may be defined by engagement of stepped shoulders 53 and 54 on the control member 45 with the respective supporting bars 12 and 13. The interengagement of the stepped shoulders 53 and 54 with the downwardly directed edge surfaces 58 and 59 of the corresponding supporting bars 12 and 13 also serves yieldingly to maintain the gripping apparatus 10 in the desired vertical disposition with respect to the carrier 11 and yet permit the apparatus 10 to swing laterally about the axis of the mounting bolt 21, as when the apparatus 10 must swing to engage a misaligned bottle (FIG. 5).

Figure 6:
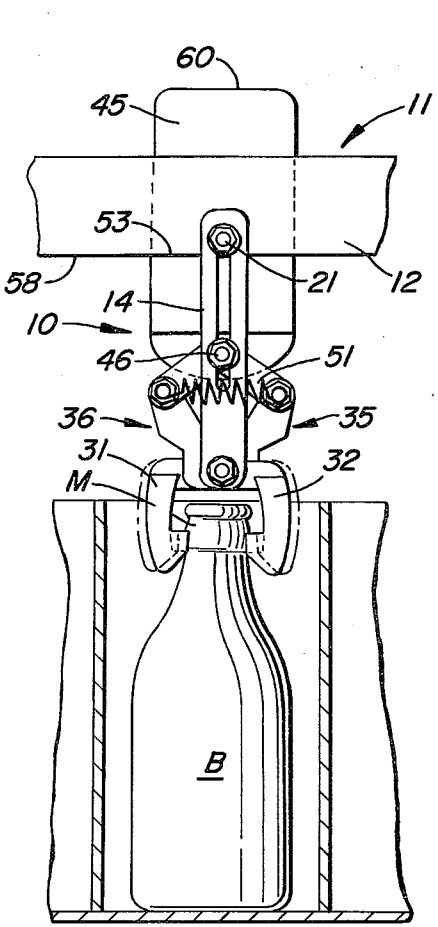

It must be appreciated that in operation the upwardly directed follower surface 60 of each control member 45 engages a strategically located cam (not shown) when it is desired that the gripper jaws 31 and 32 be opened — generally to release or to be positioned over the mouth "M" of a bottle "B" (the chain line representation in FIG. 6). The downwardly directed force applied against the follower surface 60 moves the control member 45 downwardly with respect to the frame plates 14 and 15, thereby displacing the bolt 46 carried on the control member 45. In response to the downward movement of bolt 46 the links 42 and 43 act as toggles to overcome the biasing action of spring 51 and pivot the levers 35 and 36 to move the gripper jaws 31 and 32 apart. So disposed, the jaws 31 and 32 will release a bottle held thereby, or open to be positioned over the mouth of a bottle that is to be gripped.

When the pressure applied against follower surface 60 is released, the spring 51 will contract to pivot the levers 35 and 36 so as to move the jaws 31 and 32 toward each other in their gripping position (the solid line representation in FIG. 6). At the same time, the pressure applied by the spring 51 effects a toggle-like action to links 42 and 43 which moves the control member 45 to its uppermost position.

In the uppermost position of control member 45 the stepped shoulders 53 and 54 engage the downwardly directed edge surfaces 58 and 59 of the supporting bars 12 and 13, respectively. Under the continued biasing pressure of spring 51 the full surface of each shoulder 53 and 54 is continuously urged against the edge surfaces 58 and 59 so that by orienting the shoulders 53 and 54 transversely with respect to the vertical axis 27 of the gripping apparatus 10, the engagement of the shoulders 53 and 54 with the horizontally disposed respective edge surfaces 58 and 59 will yieldingly maintain the apparatus 10 in the desired vertical disposition.

Nevertheless, because the action of the spring 51 is responsible for maintaining the gripping apparatus 10 in its vertical disposition, the apparatus 10 will be able to overcome that biasing action and swing, if required, to engage a misaligned bottle. For example, should the jaw 31 engage the mouth end of a misaligned bottle B′ (FIG. 5), the spring will permit the apparatus 10 to swing laterally, as required, for the jaws 31 and 32 to straddle the mouth M′ of the bottle B′.

Figure 4:
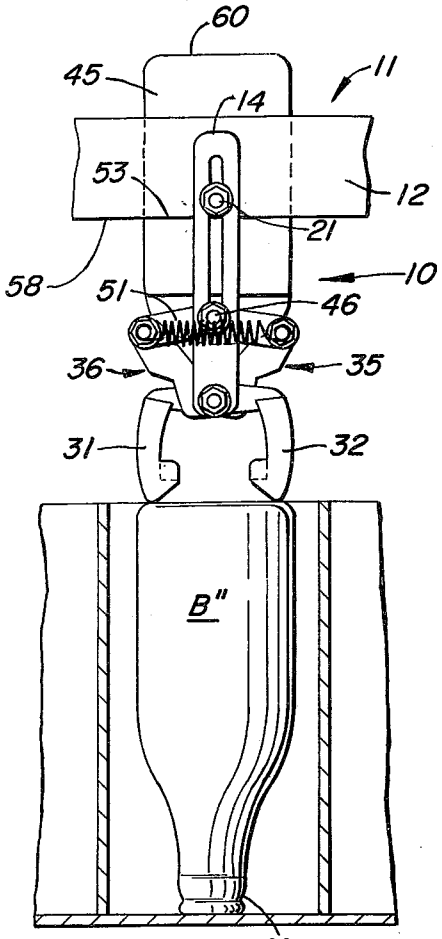
FIG. 4 is a schematic elevation of a portion of a bottle gripping apparatus embodying the concept of the present invention depicted in the disposition it would assume when engaging an inverted bottle.

Moreover, the structural configuration of apparatus 10 will not jam even if it attempts to engage a bottle (B″ in FIG. 4) that is upside down, or otherwise too big to be gripped by the jaws 31 and 32. In such a situation the spring 51 accommodates relative vertical movement between the jaws 31 and 32 and the control member 45 so as to preclude jamming or other damages to the apparatus 10.

In some environments lateral guides are provided to align each bottle gripping apparatus 10 with the locus at which each bottle is to be received or deposited. To accommodate that situation the lateral edges 61 and 62 on control member 45 (which preferably parallel the slot 50 therein) may be extended downwardly almost to the level of bolt 46 in order to provide as much surface area as practical for engaging the guides.

In addition to the foregoing functional achievements accomplished by the greatly simplified structure heretofore described, that same structure is also quite inexpensive to manufacture and maintain. Accordingly, a gripping apparatus embodying the concept of the present invention thereby accomplishes the objects thereof.

I claim:

1. A bottle gripping apparatus adapted to be mounted on at least one supporting bar, said bottle gripping apparatus comprising: a frame means; a guideway provided in said frame means; a mounting pin pivotally to secure said frame means to the supporting bar, said mounting pin being slidably received in said guideway; a fulcrum supported by said frame means; first and second, opposed gripper jaws; each said gripper jaw carried on a corresponding first and second lever arm; said first and second lever arms being convergent and being pivotally mounted on said fulcrum to permit said first and second jaws to be relatively movable toward and away from each other; spring means continuously biasing said first and second gripper jaws toward each other; a control member movably mounted on said frame means; a pivot pin secured to said control member and being slidably received in said guideway; link means connected between said pivot pin and said first and second lever arms to move said first and second jaws in response to movement of said control member.

2. A bottle gripping apparatus, as set forth in claim 1, in which a slot is provided in said control member, said mounting pin being slidably received in said slot.

3. A bottle gripping apparatus, as set forth in claim 2, in which said slot and said guideway are aligned axially of said bottle gripping apparatus.

4. A bottle gripping apparatus, as set forth in claim 3, in which said control member presents a follower surface, said follower surface being disposed substantially transversely of said guideway.

5. A bottle gripping apparatus, as set forth in claim 4, in which at least one guide surface is presented by said control member, said guide surface being disposed substantially parallel to said slot.

6. A bottle gripping apparatus, as set forth in claim 1, in which a shoulder is presented from said control member to engage said supporting bar yieldingly to orient the bottle gripping apparatus in a predetermined disposition.

* * * * *